United States Patent [19]

Reed et al.

[11] 4,326,383

[45] Apr. 27, 1982

[54] COMPACT THERMOELECTRIC REFRIGERATOR

[75] Inventors: Kingstone L. H. Reed; Ian Hatcher, both of Barrie, Canada

[73] Assignee: Koolatron Industries, Ltd., Barrie, Canada

[21] Appl. No.: 174,859

[22] Filed: Aug. 4, 1980

[51] Int. Cl.[3] ..... F25B 21/02; F25D 3/08

[52] U.S. Cl. ..... 62/3; 62/457

[58] Field of Search ..... 62/3, 457

[56] References Cited

U.S. PATENT DOCUMENTS

| | | | |
|---|---|---|---|
| 3,040,539 | 6/1962 | Gaugler | 62/3 |
| 3,168,816 | 2/1965 | Petrie | 62/3 |
| 3,194,023 | 7/1965 | Sudmeier | 62/3 |
| 3,733,836 | 5/1973 | Corini | 62/3 |
| 3,821,881 | 7/1974 | Harkias | 62/3 |
| 3,823,567 | 7/1974 | Corini | 62/3 |
| 4,007,600 | 2/1977 | Simms | 62/3 |
| 4,242,874 | 1/1981 | Simms | 62/3 |

*Primary Examiner*—Lloyd L. King

*Attorney, Agent, or Firm*—Cahill, Sutton & Thomas

[57] ABSTRACT

A compact thermoelectric refrigerator includes a storage compartment, the lower portion of which is lined with a thin, high-conductivity aluminum liner which functions as an internal heat exchanger. The storage compartment is separated by means of a dividing wall from a compartment containing a thermoelectric module, a low profile, high density external heat exchanger including an extruded high thermal conductivity aluminum base and a plurality of closely spaced high thermal conductivity fins attached to the base by means of thermal epoxy, and a centrifugal fan disposed above the external heat exchanger and driven by a fan motor disposed in a recess in a wall of the thermoelectric refrigerator. Outside air is drawn by the centrifugal fan through an air intake grill located in the upper portion of an end panel and is forced through the fins of the external heat exchanger and out of an air outlet grill located along the lower edge of the end panel. The thermoelectric module is in thermal contact with the lower portion of the side of the aluminum liner, and conducts heat away from the aluminum liner to the external heat exchanger. The thickness and conductivity of the aluminum liner are such that a predetermined temperature gradient exists from one end of the storage compartment to the other end thereof.

7 Claims, 9 Drawing Figures

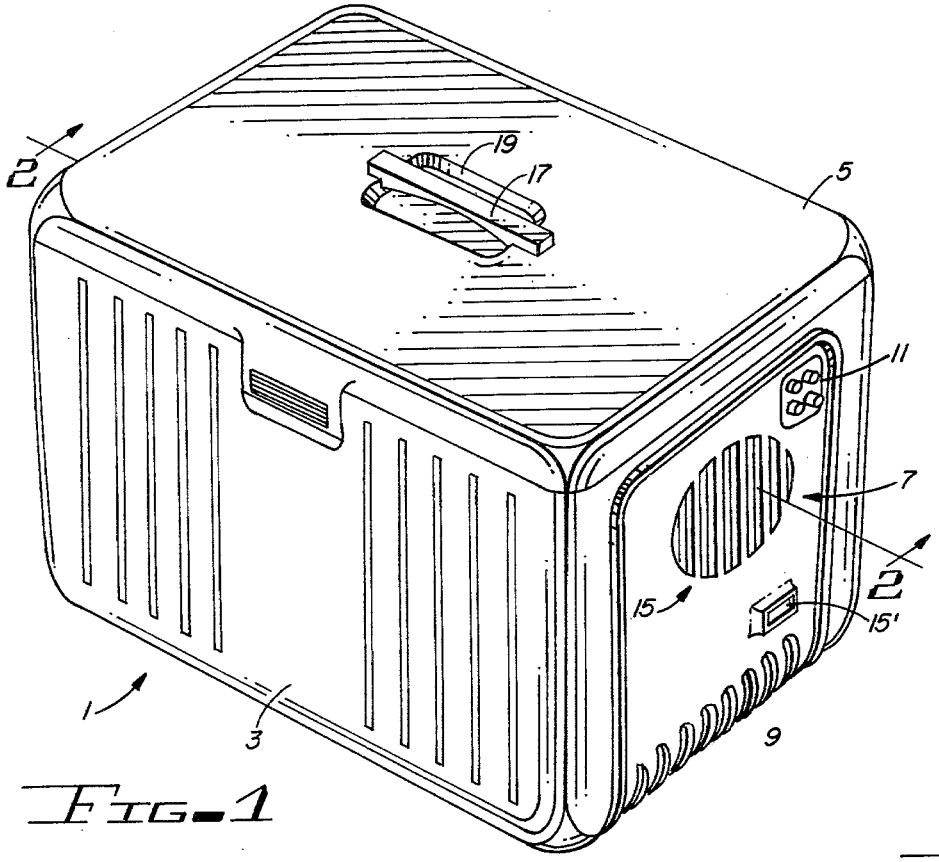
FIG-1
FIG-2
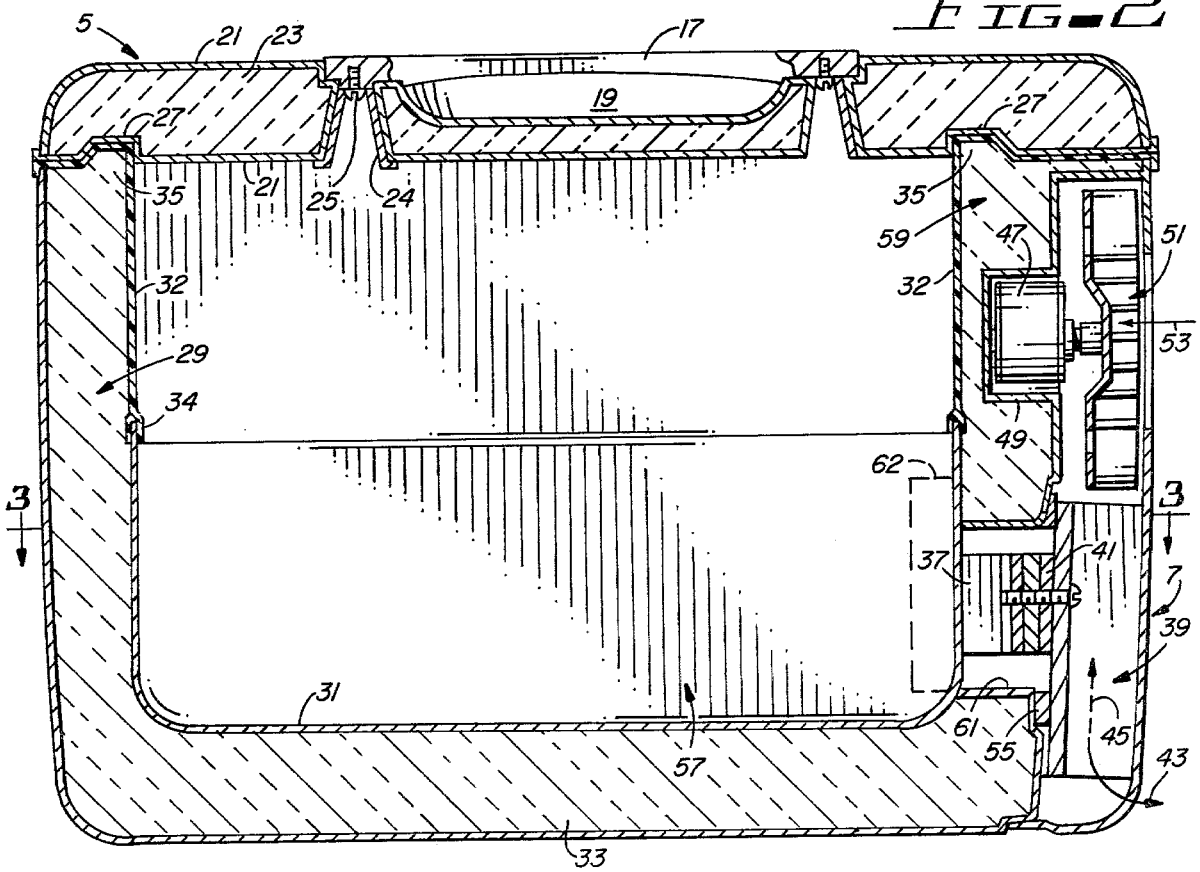

COMPACT THERMOELECTRIC REFRIGERATOR

BACKGROUND OF THE INVENTION

1. Field of the Invention

The invention relates to thermoelectric refrigerators, and particularly to highly compact portable thermoelectric refrigerators.

2. Description of the Prior Art

Portable ice boxes or coolers have been widely used by motorists, outdoorsmen, etc. despite the fact that portable ice coolers have numerous shortcomings because there have been no viable, commercially feasible alternatives to their use. For example, the ice which must be utilized therein greatly increases the weight, and melts rapidly, sometimes causing perishables stored in the cooler to become waterlogged or otherwise spoiled and frequently is unavailable when and where it is needed. Consequently, several thermoelectric refrigerators, including the one described in the co-pending patent application "CONTROL CIRCUITRY FOR THERMOELECTRIC COOLER", Ser. No. 6/102,447, filed Dec. 11, 1979, by Michael A. Reed, have become increasingly popular. However, the thermoelectric refrigerator described in that patent application, while being very satisfactory for implementation of medium sized and large thermoelectric refrigerators, is less satisfactory for a very small thermoelectric refrigerator. There has been, prior to the present invention, an unmet need for a very small, lightweight, highly compact thermoelectric refrigerator having exterior dimensions of approximately 11 inches by 11 inches by 16 inches, wherein the size of the interior storage compartment is maximized.

Accordingly, it is an object of the invention to provide a lightweight, low cost thermoelectric refrigerator having maximum storage space for a particular set of external dimensions.

Prior thermoelectric refrigerators typically have an internal heat exchanger which either consists of a smooth solid plate across the bottom of the storage compartment, wherein a thermoelectric module contacts the solid plate approximately centrally, or a side mounted finned internal heat exchanger, wherein the thermoelectric module approximately centrally contacts the finned internal heat exchanger. In either case, relatively uniform cold temperatures exist across such internal heat exchangers, resulting in relatively uniform temperatures in the storage compartments of the prior thermoelectric refrigerators, even after thermal equilibrium has been established therein. However, there is frequently a need to store different perishable foods at different temperatures, as some foods need to be kept relatively colder than others. For example, it may be desirable to keep foods such as meats and dairy products approximately 10 degrees colder than certain other foods such as lettuce.

Accordingly, it is an object of the invention to provide a portable thermoelectric refrigerator which provides a predetermined temperature gradient in a single compartment which contains perishable foods or the like.

SUMMARY OF THE INVENTION

Briefly described, and in accordance with one embodiment thereof, the invention provides a portable thermoelectric refrigerator which includes a storage compartment bounded by a substantially rectangular insulated housing composed of rigid urethane foam covered by a hard plastic surface, the storage compartment having an open top coverable by an insulated cover hingeably attached to the housing, the lower portion of the storage compartment being lined with a high thermal conductivity metal liner which functions as an internal heat exchanger. A thermoelectric module is mounted in intimate thermal contact, by means of thermal grease and a conductor block, with the thermally conductive metal liner at a portion of the side wall thereof located adjacent to the bottom of the thermally conductive liner. A low profile, high density external heat exchanger composed of an extruded aluminum base having a plurality of grooves, wherein a plurality of fins are attached to the base by means of conductive epoxy, is thermally connected to the heat exchanger by means of thermal grease. The thermally conductive metal liner, the extender block, and the base of the heat exchanger are composed of extruded, high thermal conductivity aluminum, the fins also being composed of high thermal conductivity aluminum. The thermoelectric module and extender block are disposed in an opening in the lower portion of an insulated divider wall disposed between the storage compartment and an end panel of the thermoelectric refrigerator. An air outlet grill is disposed along a lower end edge of the end panel immediately beneath the external heat exchanger. A centrifugal fan mounted on the shaft of a fan motor is located in the end compartment immediately above the external heat exchanger, the fan motor extending into a recess in the divider wall. An air inlet grill in the upper portions of the end panel is aligned with the centrifugal fan, the upper portion of the centrifugal fan being closely surrounded by a shroud, the lower portions of the shroud extending on either side of the external heat exchanger. In one embodiment of the invention, a low profile finned internal heat exchanger is mounted on the inner wall of the aluminum liner adjacent to the extender block in order to provide more efficient thermal transfer of heat from the storage compartment via the thermoelectric module to the external heat exchanger. The thickness of the aluminum liner is selected such that a predetermined temperature gradient exists across the storage compartment from the side at which the thermoelectric module is connected to the opposite side of the storage compartment, enabling colder storage of food such as dairy products and meats adjacent to the thermoelectric module end of the storage compartment, while allowing safe, less cold storage of delicate items, such as lettuce, at the opposite end of the storage compartment. The combination of elements provided in the described embodiment of the invention results in a lightweight efficient thermoelectric refrigerator having a maximum sized storage compartment for the external dimensions of the thermoelectric refrigerator.

BRIEF DESCRIPTION OF THE DRAWINGS

FIG. 1 is a perspective view of the thermoelectric refrigerator of the invention.

FIG. 2 is a section view taken along section line 2—2 of FIG. 1.

DESCRIPTION OF THE INVENTION

Figure 3:
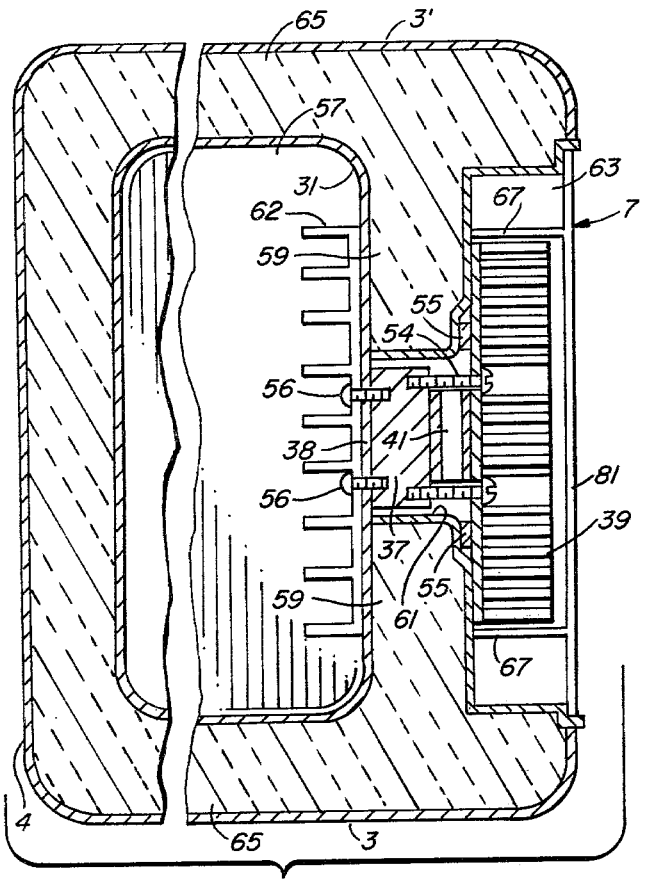
FIG. 3 is a partial section view taken along section line 3—3 of FIG. 2.

Referring now to the drawings, especially FIGS. 1—3, thermoelectric refrigerator 1 includes a front wall 3, a rear wall 3', and a left end wall 4. A removable end panel 7, subsequently described in detail, covers an end compartment of thermoelectric refrigerator 1. A cover 5 is hingeably connected to the upper end of rear wall 3'. A low profile handle 17 is attached centrally on cover 5 over a recess 19. A latch of any suitable design is provided on the front edge of cover 5 for engaging the upper edge of front wall 3. Both cover 5 and the lower portion of thermoelectric refrigerator 1 are composed of rigid urethane foam insulation, the inner and outer surfaces of the cover and the various walls being covered with high impact ABS plastic and a conductive aluminum liner, subsequently described.

In FIG. 2, reference numeral 21 designates the "skin" composed of high impact ABS plastic, and reference numeral 23 designates the rigid urethane foam insulation. Reference numeral 29 designates the urethane foam insulation in the lower portion of thermoelectric refrigerator 1.

Screws 25, extending from the top of a recess 24 in the underside of cover 5, engage the ends of handle 17, thereby affixing it to the upper surface of cover 5. In order to provide improved sealing of cover 5 with respect to the upper edges of the walls of storage compartment 57, sealing ridges 35 are provided on the upper ends of various walls, including front wall 3, rear wall 3', and left end wall 4. Corresponding ridge receiving grooves 27 are provided in the undersurface of cover 5.

A dividing wall 59 extending from the bottom to the top of storage compartment 57 bounds the left side of storage compartment 57 and separates it from a region also bounded by end panel 7 wherein the electric fan, control circuitry, thermoelectric module, and external heat exchanger (all subsequently described) are disposed. A sealing ridge 35, similar to the ridges 35, subsequently described, is provided on the upper edge of dividing wall 35, and a corresponding ridge-receiving slot 27 is provided on the under surface of cover 5.

An aluminum liner 31 covering the bottom and lower side walls is attached to the inner surfaces of bottom 33 and the above mentioned side and divider walls. Aluminum liner 31 functions as an internal heat exchanger for the thermoelectric components of thermoelectric refrigerator 1. It is composed of high thermal conductivity grade 6351 aluminum having a thickness of approximately 40 mils.

The upper portions of the side walls of storage compartment 57 are lined with high impact ABS plastic liner designated by reference numeral 32 in FIG. 2. The lower edge of plastic liner 32 has a bifurcated end section which receives the upper aluminum liner 31, providing a suitable seal therewith.

Figure 6A:
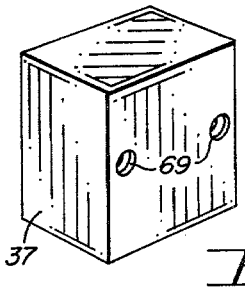
FIGS. 6A and 6B disclose several alternate embodiments of a heat conductor block utilized in the refrigerator of FIG. 1.
Figure 6B:
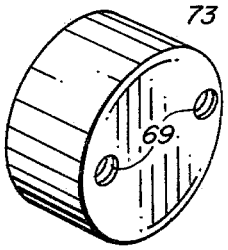

An opening 61, extending through the lower portion of divider wall 59, accommodates a heat conductor block 37 which is attached in "intimate" thermal contact with the lower portion of the side wall of aluminum liner 31. This intimate contact is obtained by means of thermal grease, described in co-pending application, Ser. No. 6/102,447, entitled "CONTROL CIRCUITRY FOR THERMOELECTRIC COOLER", by Michael A. Reed, filed Dec. 11, 1979, and assigned to the present assignee and incorporated herein by reference. Heat conductor block 37 can have several configurations, alternately shown in FIGS. 6A and 6B. Heat conductor block 37 includes tapped holes through which bolts extend for drawing heat conductor block 37, a side wall of aluminum liner 31, thermoelectric module 41, and external heat exchanger 39 together. It is very important that heat conductor block 37 be composed of high thermal conductivity aluminum. Heat conductor block 37 can, for example, be composed of extruded aluminum, which has low weight and high thermal conductivity, rather than cast aluminum, which has significantly lower thermal conductivity.

Thermoelectric module 41, which can be the same thermoelectric module (or one similar thereto) referred to in the above referenced Reed application, has one surface which contacts heat conductor block 37 by means of thermal grease and another opposed surface which contacts the base 89 of external heat exchanger 39 by means of thermal grease. External heat exchanger 39 is larger than opening 61 and extends beyond the peripheral edge thereof. A suitable gasket 55 provides an airtight seal between opening 61 and base 89 of external heat exchanger 39.

External heat exchanger 39 is drawn toward external heat conductor block 37, as shown in FIG. 3, by means of a pair of bolts 54, with sufficient torque to ensure the desired high level of thermal contact between external heat exchanger 39, thermoelectric module 41, and heat conductor block 37. FIG. 3 also shows bolts 56, which draw aluminum liner 31 against the inner surface of heat conductor block 37 to ensure the desired level of thermal contact therebetween.

Figure 8:
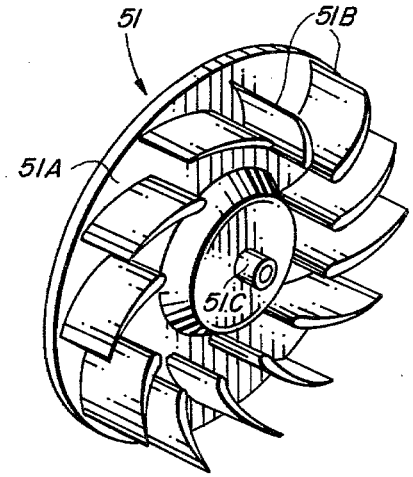
FIG. 8 is a perspective view of a centrifugal fan utilized in the refrigerator of FIG. 1.

Fan motor 47 is disposed in a recess 49 in the upper portion of divider wall 59. Fan motor 47 and recess 49 are located so that centrifugal fan blade 51 is located immediately above external heat exchanger 39, thereby reducing the width of the space required between end panel 7 and divider wall 59 to accommodate fan 51 and motor 47. A circular grill 15 in end panel 7 is coaxially disposed adjacent to centrifugal fan blade 51. The openings of grill 15 are 5/32 of an inch wide and are spaced 3/32 of an inch apart in one embodiment of the invention. As best seen in FIG. 8, centrifugal fan blade 51 includes a round, flat back plate 51A, a center hole 51C, and a plurality of vanes 51B. As indicated by arrow 53 (FIG. 2), air is drawn into grill 15 by centrifugal fan blade 51, and is forced between the high density fins of external heat exchanger 39 and out of outlet grill openings 9, as subsequently explained.

Referring now to FIG. 1, it is seen that outlet openings 9 are provided along the lower edge of end panel 7. In one preferred embodiment of the invention, the exhaust grill openings are 3/16 of an inch wide and are spaced $\frac{1}{8}$ of an inch apart. Their height is accurately depicted in FIG. 1, assuming that the height of thermoelectric refrigerator 1 is 11 inches, its width is 11 inches and its length is 16 inches.

The interior dimensions of storage compartment 57, with cover 5 closed, are $8\frac{1}{2}$ inches in depth, 11 inches in length, and 8 inches in width. The height of the side walls of aluminum liner 31 is 4 inches.

Figure 7:
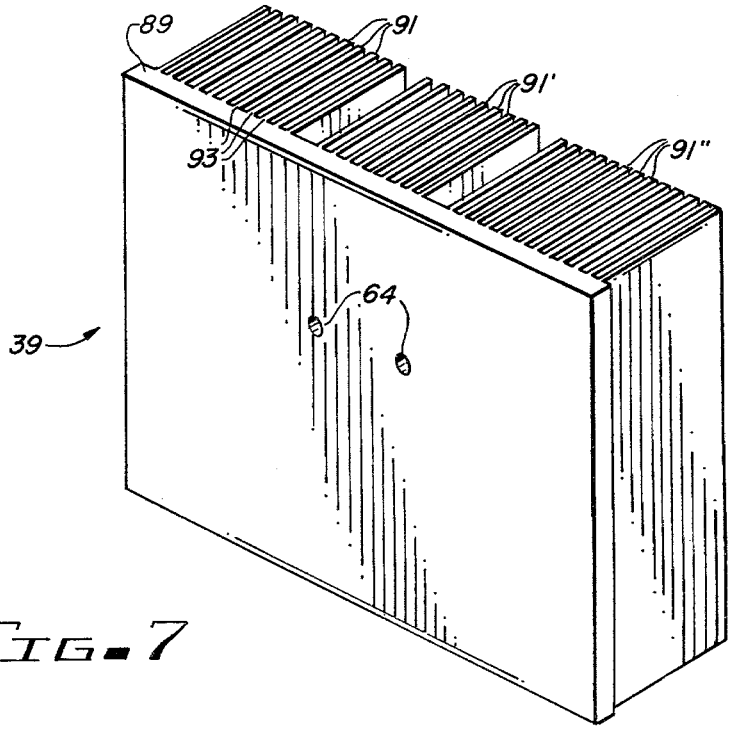
FIG. 7 is a perspective view of an external heat exchanger utilized in the refrigerator of FIG. 1.

The configuration of external heat exchanger 39 is best described with reference to FIG. 7. In the presently preferred embodiment of the invention, the dimensions of base 89 are approximately 5 inches by 3.5 inches by 0.2 inches. Base 89 is composed of extruded high thermal conductivity aluminum. Each of fins 91, 91' and 91'' extend into a corresponding groove such as 93 in the outer surface of base 89. (Grooves 93 are formed during extrusion of base plate 89.) A pair of holes 64 extend through base plate 89 for accommodating bolts 54 (FIG. 3). The gaps between the three groups of fins 91, 91' and 91'' are provided solely for the purpose of accommodating the heads of bolts 54.

Each of fins 91, 91' and 91'' is composed of high conductivity grade 1100 aluminum. Each of the fins is approximately 40 mils in thickness and has a dimension of approximately 1 inch by 3.5 inches. The fins are spaced only 2 millimeters apart. It should be noted that each of fins 91, 91' and 91'' is attached within the corresponding grooves 93 of base plate 89 by means of thermal epoxy which contains ninety percent aluminum, and is sold under the trademark "DEVCON".

Air drawn in through grill 15 (as indicated by reference arrow 53 in FIG. 2) by centrifugal fan 51 is forced through the high density fins 91, 91', etc., and out of lower grill openings 9, as indicated by arrow 43. The diameter of centrifugal fan 51 is approximately 3.5 inches, and the depth of each of vanes 51B is approximately 0.8 inches and the length of each vane is approximately 1 inch.

Figure 4:
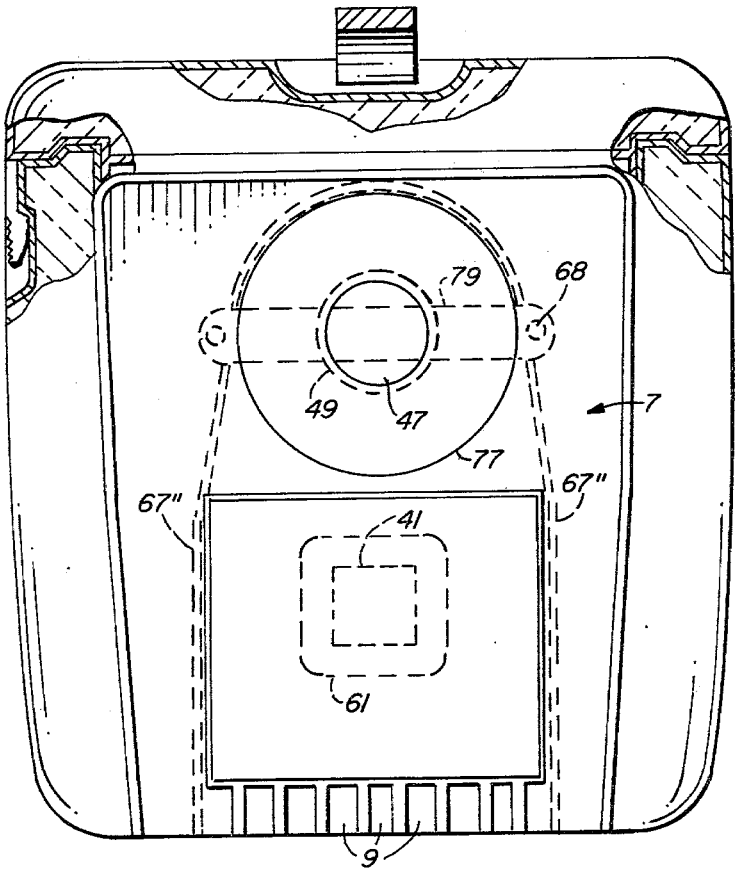
FIG. 4 is a partial cutaway end view of a right end portion of the refrigerator of FIG. 1.

Shroud 67 has an upper curved portion 67' which closely surrounds the upper portion of centrifugal blade 51, separated therefrom by a tolerance of approximately one fourth of an inch. The lower portions 67'' of shroud 67 accommodate external heat exchanger 39. As best seen in FIG. 4, fan motor 47 is supported in recess 49 by means of bracket 79, which is attached by means of screws 68 to divider wall 59.

Figure 5:
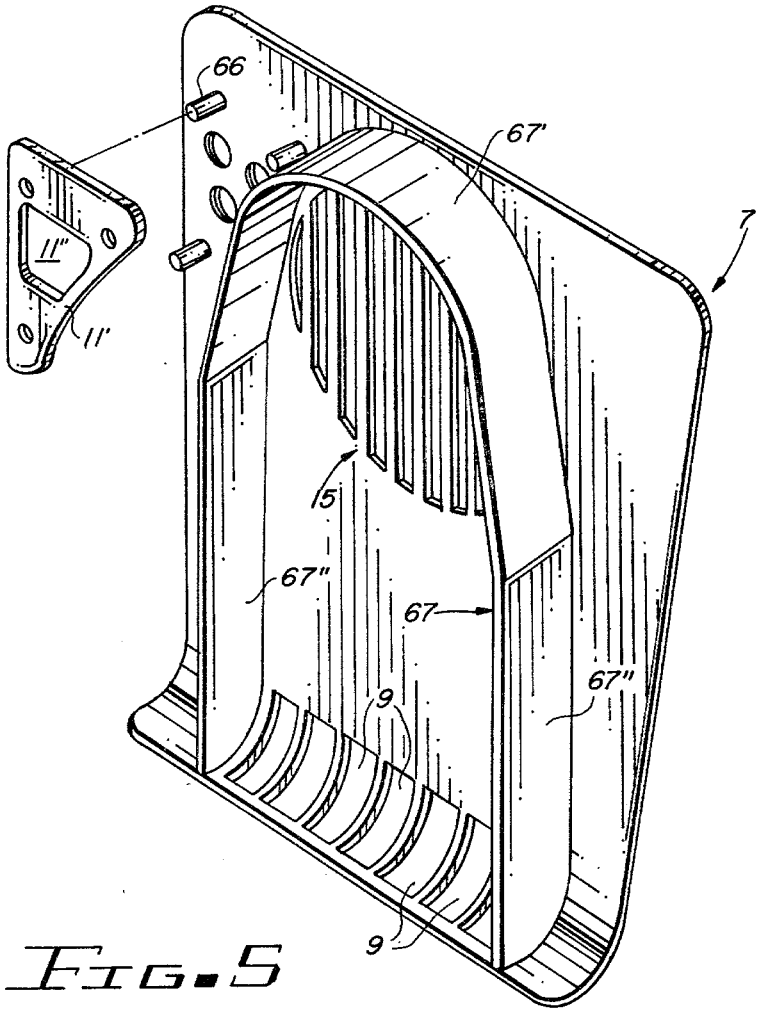
FIG. 5 is a perspective rear view of the end panel of the refrigerator of FIG. 1.

Space 63 between the outer surface of the left portion 67'' of shroud 67, as shown in FIG. 5, accommodates a printed circuit board 11' having control circuitry represented by reference numeral 11'' thereon. Circuit board 11' is supported on a plurality of standoffs such as 66, wherein controls from control panel 11 extend through openings in end panel 7 to facilitate controlling the temperature of thermoelectric refrigerator 1. Various control circuits could be utilized, but the control circuitry disclosed in the above referenced Reed application would be entirely satisfactory.

In FIG. 1, reference numeral 15' designates an electrical connector for attachment of a power cord to thermoelectric refrigerator 1 in order to conduct a 12 volt supply voltage to control circuit 11'.

Fan motor 47 can be implemented by means of a Mabachi motor No. RF51012620, which causes centrifugal fan 15 to rotate at approximately 1500–2000 revolutions per minute.

In an alternate embodiment of the invention, a low profile internal heat sink, represented by dotted line 62 in FIG. 2 and also designated by reference numeral 62 in FIG. 3, can be fastened in storage compartment 57 against the inner surface of aluminum liner 31 adjacent to heat conductor block 37. Although this reduces the amount of storage space available in storage compartment 57, it somewhat improves the cooling efficiency of thermoelectric refrigerator 1.

In accordance with the present invention, it should be noted that the above selected combination of elements was arrived at only after extensive experimentation and construction on a "trial and error" basis of a number of experimental embodiments of thermoelectric refrigerator 1. The composition, thickness and height of aluminum liner 31 were selected in order to provide a suitable temperature gradient (roughly ten degrees) from right to left in storage compartment 57, so that dairy products, meats and the like could be kept very cold by storing them adjacent to heat conductor block 37, while more delicate foods, such as lettuce, could be stored in the left portion of storage compartment 57. It was found that provision of heat conductor block 37 in the lower portion of divider wall 59 and adjacent to the bottom of the side of aluminum liner 31 results in allowing use of a shallower, less expensive aluminum liner 31 and facilitates the most efficient flow of heat from the left portion of aluminum liner 31 to heat conductor block 37. This necessitates placement of external heat sink 39 in the lower portion of the cavity between end panel 7 and divider wall 59. In order to obtain a minimum external length dimension for thermoelectric refrigerator 1, it has been found to be necessary to provide recess 49 in divider panel 59. Use of a centrifugal fan blade and a very high density of fins only one inch in height for external heat exchanger 39 has been found to result in a maximum dimension from the inner surface of divider wall 59 to the outer surface of end panel 7. Use of a centrifugal fan which draws air through grill 15 located near the upper portion of end panel 7 avoids drawing of dust particles into grill 15, which would be more likely to happen if outside air were drawn into end panel 7 through lower grill openings 9. This is an important consideration due to the fact that the fins are spaced very closely together. Building of dust particles on the fins of external heat exchanger 39 would tend to reduce air flow therethrough and would reduce the thermal efficiency of refrigerator 1. If air were drawn into end panel 7 through grill openings 9 at the lower edge of end panel 7, ordinarily there would be a much larger amount of such dust deposited on the fins of external heat exchanger 39. Furthermore, there is much less likelihood of external obstruction of grill openings of grill 15 than of grill openings 9. Since centrifugal fan 51 operates much more efficiently in denser air than in rarified air, efficiency of thermoelectric refrigerator 1 is exhausted far less by inadvertent obstruction of grill openings 9 than would be the case if air were drawn into, rather than exhausted from, grill openings 9. It was discovered that much higher thermal efficiency results from utilizing an extruded, grooved base 89 and utilizing thermal epoxy to attach individual fins 91, 91', etc., in the grooves by means of the thermal epoxy than to use cast aluminum fins. By fabricating the external heat exchangers in this manner, it was found to be possible to achieve substantially higher fin density and far greater overall thermal efficiency than was obtained utilizing a cast aluminum external heat exchanger.

While the invention has been described with reference to a particular preferred embodiment thereof, those skilled in the art will be able to make various modifications in the disclosed structure without departing from the true spirit and scope of the invention, as set forth in the appended claims.

We claim:

1. A portable thermoelectric refrigerator comprising in combination:

a. an insulated housing having a bottom, front and rear walls, and first and second end walls bounding a storage compartment, said thermoelectric refrigerator also including an openable cover for covering the top of said storage compartment;

b. a thermally conductive metal liner covering only the bottom of said storage compartment and the lower portions of said front, rear, and first and second end walls of said storage compartment;

c. a thermally conductive block extending through said first end wall and thermally contacting said thermally conductive metal liner;

d. a thermoelectric module thermally contacting said thermally conductive block;

e. an external heat exchanger located in a region on the opposite side of said first end wall from said storage compartment for thermally contacting said thermoelectric module, said external heat exchanger including a base of thermally conductive metal and a plurality of closely spaced parallel fins extending substantially perpendicularly from said base, each of said fins having a length that is substantially greater than a width thereof, said base and said fins being oriented vertically relative to the bottom of said thermoelectric refrigerator, said thermoelectric means removing heat from said thermally conductive metal liner, said thermally conductive liner having a thickness that causes said thermally conductive liner to produce a thermal gradient in said storage compartment from said first wall to said second wall, said thermal gradient being of sufficient magnitude to cause temperatures in portions of said storage compartment adjacent to said first end wall to be a predetermined amount colder than temperatures in portions of said storage compartment adjacent to said second end wall;

f. centrifugal fan means disposed directly above said external heat exchanger for drawing air from outside of said thermoelectric refrigerator into an elevated air inlet and forcing substantially all of that air between said fins, said centrifugal fan means including a circular plate mounted on a shaft of a fan motor and a plurality of vanes extending from a major surface of said circular plate;

g. a shroud element surrounding the upper portion of said centrifugal fan means and extending to fins on opposed sides, respectively, of said external heat exchanger; and h. an end panel having said air inlet therein adjacent to said centrifugal fan means and also having an air outlet at the bottom edge of said end panel, said end panel and the outer surface of said first end wall cooperating with said shroud element to enclose said centrifugal fan means and said external heat exchanger to cause substantially all air drawn into said elevated air inlet by said centrifugal fan means to be forced to flow between various ones of said fins from the top of said external heat exchanger to the bottom thereof, said first end wall including a recess in the outer surface thereof for receiving the fan motor.

2. The portable thermoelectric refrigerator of claim 1 wherein said heat conductor block and said base are composed of extruded aluminum.

3. The portable thermoelectric refrigerator of claim 2 wherein said fins are attached to said base by means of thermally conductive epoxy.

4. The portable thermoelectric refrigerator of claim 1 wherein said fins are spaced approximately two millimeters apart and each have a thickness of approximately forty mils.

5. The thermoelectric refrigerator of claim 4 further including a finned internal heat exchanger attached to the interior surface of said thermally conductive metal liner adjacent to said heat conductor block.

6. The thermoelectric refrigerator of claim 1 wherein the dimensions of said storage compartment are approximately eleven inches in length, eight inches in depth, and eight inches in width, the thickness of said thermally conductive metal liner is approximately forty mils, the length and width of said base of said external heat exchanger being approximately five inches and three and one half inches, respectively, the length and widths of each of said fins being three and one-half inches and one inch, respectively.

7. The thermoelectric refrigerator of claim 1 wherein the external dimensions of said thermoelectric refrigerator are approximately sixteen inches in length, eleven inches in depth, and eleven inches in width.

* * * * *